US007942244B2

(12) United States Patent
Lombard

(10) Patent No.: US 7,942,244 B2
(45) Date of Patent: May 17, 2011

(54) LIFTING ASSEMBLY

(76) Inventor: Xavier Lombard, Outremont (CA)

( * ) Notice: Subject to any disclaimer, the term of this patent is extended or adjusted under 35 U.S.C. 154(b) by 1061 days.

(21) Appl. No.: 11/658,966

(22) PCT Filed: Jul. 28, 2005

(86) PCT No.: PCT/FR2005/050628

§ 371 (c)(1),
(2), (4) Date: Mar. 23, 2007

(87) PCT Pub. No.: WO2006/021715

PCT Pub. Date: Mar. 2, 2006

(65) Prior Publication Data

US 2008/0011548 A1 Jan. 17, 2008

(30) Foreign Application Priority Data

Jul. 30, 2004 (FR) ..... 04 51737

(51) Int. Cl.
*B66F 11/04* (2006.01)

(52) U.S. Cl. ..... 182/141; 182/187; 182/188; 187/270

(58) Field of Classification Search ..... 182/141, 182/146, 187, 188; 187/270
See application file for complete search history.

(56) References Cited

U.S. PATENT DOCUMENTS

| | | | | | |
|---|---|---|---|---|---|
| 1,505 | A | * | 3/1840 | Penfield | 182/47 |
| 3,415,343 | A | * | 12/1968 | Svensson | 187/270 |
| 3,516,512 | A | * | 6/1970 | Hugo et al. | 182/16 |
| 3,743,247 | A | * | 7/1973 | Willke et al. | 254/89 R |
| 3,924,710 | A | * | 12/1975 | Shohet | 187/270 |
| 4,160,538 | A | * | 7/1979 | Armstrong | 254/89 R |
| 4,203,576 | A | * | 5/1980 | Sutton | 254/89 R |
| 4,467,889 | A | * | 8/1984 | Maubach et al. | 182/103 |
| 4,498,556 | A | | 2/1985 | Garton et al. | |
| 4,516,663 | A | * | 5/1985 | D'Alessio et al. | 187/270 |
| 5,579,865 | A | * | 12/1996 | Butler et al. | 182/141 |
| 5,927,440 | A | * | 7/1999 | Freeman | 187/270 |
| 6,250,426 | B1 | * | 6/2001 | Lombard | 182/146 |
| 6,523,647 | B2 | * | 2/2003 | Duplessis | 187/270 |

FOREIGN PATENT DOCUMENTS

| | | |
|---|---|---|
| EP | 1 260 480 | 11/2002 |
| FR | 2 671 336 | 7/1992 |
| FR | 2 710 361 | 3/1995 |
| WO | WO 95/16631 | 6/1995 |
| WO | WO 01/05695 | 1/2001 |

* cited by examiner

*Primary Examiner* — Alvin C Chin-Shue
*Assistant Examiner* — Colleen M Quinn
(74) *Attorney, Agent, or Firm* — Patterson Thuente Christensen Pedersen, P.A.

(57) ABSTRACT

The invention relates to a lifting assembly (10, 20, 30, 40, 50, 60, 70, 80, 90) comprising: a rack mast, a platform (12, 23, 33, 43, 53, 91), and at least one power unit (100, 300, 400, 500, 600, 800, 900, 901) which is mounted to the mast and which controls the vertical movement of the platform along the length thereof. The invention is characterized in that the power unit comprises a plurality of modular elements including at least one motor block (101, 200, 201, 301, 401, 501, 604, 621, 801, 904), at least one upper roller box (102, 205, 210, 305, 404, 503, 627, 903) and at least one lower roller box (103, 206, 304, 405, 502, 601, 629, 902). According to the invention, each of the modular elements is equipped with mechanical fastening means (610, 611, 612) which are aligned with the mechanical fastening means of an adjacent modular element.

15 Claims, 8 Drawing Sheets

LIFTING ASSEMBLY

RELATED APPLICATIONS

This application claims priority to PCT Application No. PCT/FR2005/050628 filed Jul. 28, 2005, and French Application No. 0451737 filed Jul. 30, 2004 the disclosures of which are hereby incorporated by reference in their entirety.

TECHNICAL FIELD

The invention concerns a lifting assembly. By "lifting assembly" is meant a lifting device in which a platform is capable of having various heights on a mast, enabling a vertical movement of a load. For example, a lifting assembly can be an elevator, a load hoist, a rack platform, etc. More precisely, the invention concerns a power unit for the lifting assembly, having a power function and a guiding function for the platform along the mast. The invention also concerns a gear motor specifically able to be integrated into a power unit of a lifting assembly. The invention further concerns a power unit equipped with a braking regulator device. The said device particularly finds applications on lifts equipped with two masts, and with two power units destined to move up and down simultaneously along the two masts, so as to move a platform mounted between the two masts. The invention finds applications, amongst others, in the building sector, for example on construction sites.

An aim of the invention is to embody a power unit capable of lifting and guiding different lifting devices along a mast. The lifting devices can be different in the sense that the plates are weighted and have varying bulk, but also in the sense that a same plate can require varying power and guiding functions depending on the needs of the operator. Another aim of the invention is to embody a gear motor, capable of being mounted inside a power unit of a lifting assembly, the said power unit being capable of reducing the strain in the guiding elements and in the reactions on the mast carrying the power unit. Such power unit can be especially beneficial in the case where the platform held up by the power unit extends beyond the plumb line on the rack mast.

BACKGROUND OF THE INVENTION

Currently, on construction sites, a lift is mounted along a wall of a building or down a shaft. A scaffolding height is meant to increase as a construction height increases. In order to easily raise and lower the necessary materials and/or workforce for construction purposes, the scaffolding comprises a lifting assembly. The lifting assembly is equipped with at least one rack mast. The mast can be gradually mounted as the building rises or once the structural framework has been completed. A motorised platform can be moved vertically along the rack mast, and can thus have varying heights on the said mast. The platform is powered by a power unit including at least one motor block and at least two roller boxes. The power unit is guided along the rack mast. The platform is fixed to the power unit which lifts it and guides it along the said rack mast.

The power units known today are of the monoblock type. By "monoblock" is meant the motor block, fulfilling the power function, and the roller box, fulfilling the guiding function, together forming a single and same unit. The power function can not be dissociated from the guiding function.

Moreover, this monoblock power unit has a specific structure which changes according to the platform to be lifted and according to the rack mast along which it is guided. Indeed, the bulk of the base plate of an elevator, of a working platform, of a load hoist, or of a materials' hoist, is not the same. Each one of these lifting assemblies must, therefore, be placed differently in relation to the mast on the one hand, and to the power unit on the other.

For example, in the case of a load hoist, the load plate of the said load hoist is interlocked with a rack mast through the intermediary of a power unit. A section of the mast carrying the rack is directed outwards in relation to the construction along which the load hoist is mounted, and extends in a plane, parallel to a plane of the construction. The load plate is hung onto a lateral side of the power unit, i.e. the power unit is located next to the load plate. The load plate cannot be positioned on the side hosting the motors due to the bulk of the latter and the necessity for the load plate to descend as near to the ground as possible.

In the case of a construction-site elevator, the platform for the said elevator is interlocked with a rack mast through the intermediary of a different power unit. The section of the mast carrying the rack is directed outwards in relation to the construction along which the elevator is mounted, but extends in a plane perpendicular to a plane of the construction. The platform is hung underneath the power unit. Indeed, a construction site elevator transports heavy-weight material. It is thus advantageous if the platform of the construction-site elevator is able to touch the ground when the said elevator is in the lower position on the rack mast in order to facilitate the loading of the said elevator, for example using a hand truck or a fork-lift truck.

In the case of a self-elevating platform, the base plate is also hung onto the lateral sides of the power unit. However, the section of the mast carrying the rack extends in a different plane than the mast carrying a load hoist. Hence, in this case, the power unit also has a different structure.

It is, therefore, not currently possible to use a same power unit enabling on a construction site, for example, the elevation along a mast of a construction-site elevator, a rack platform, a rack lift or other such type. Depending on the position of the mast section which holds up the rack and depending on the lifting device concerned, the overall structure of the power unit changes.

SUMMARY OF THE INVENTION

In the invention, we are seeking to resolve the problem explained above by proposing a power unit that can be adapted to all types of lifting devices. In order to do that, the power unit of the invention is composed of a plurality of modular elements, which can be interlocked with each other, then separated as necessary, in order to fulfil a modular power function and a modular guiding function, depending on the lifting device concerned and according to an orientation of the rack mast. By "modular" is meant that each element is independent, the said modular elements being able to be piled up in a differing order and in varying numbers depending on the needs. For example, the elements fulfilling the power function can be of varying numbers, depending on the weight to be lifted and/or according to the desired speed. Furthermore, the elements fulfilling the guiding function can be of varying numbers depending on the needs. The modular elements fulfilling the power function are interchangeable with each other, in the same way as the modular elements fulfilling the guiding function are interchangeable among themselves. The lifting device of the invention comprises at least a rack mast along which a platform of the lifting device can be raised and lowered as required using a modular power unit according to the invention. The power unit comprises at least one motor block, fulfilling the power function, and at least two roller boxes fulfilling the guiding function along the rack mast. The roller boxes surround the motor block in a manner to ensure a proper guiding of the motor block along the mast, and to prevent any wrenching of the motor block in relation to the rack mast. It is possible to equip the power unit with several roller boxes, for example four, two roller boxes being located above the motor block and two roller boxes being located beneath the motor block. The power unit itself can be equipped with several motor blocks depending on the importance of the weight to be lifted. The modular elements of the power unit are interlocked with each other using mechanical connections, coinciding with each other.

The power unit of the invention, thus modular in its power function and in its guiding function, can be hung on all sorts of rack masts; i.e., whatever the orientation of the section of the mast carrying the rack in relation to a wall along which the mast is mounted. Likewise, the plate of the lifting device can be hung above, below, on the right side, on the left side, on the front side or on the rear side of the power unit, depending on the use of the base plate. Hence, a same power unit can enable a construction-site elevator, a self-elevating platform, or any other lifting device, to move upwards and be guided.

It is possible to insert a beam between the motor block and a roller box. Such a beam enables, by increasing the spacing between the guiding rollers, to reduce the strain inside the roller boxes and inside the rack mast. A load, even heavy, is then more easily raised up along the mast.

The invention also concerns a motor block whose rigidity is important, though having a reduced total weight. The block motor of the invention is equipped with a supporting plate on which a motor and a gear box are fixed. The gear motor, according to the invention, is equipped with a reaction arm, interlocked with the plate, and with a drive shaft for the gear box. The motor and the gear box are mounted in a floating manner in relation to the drive shaft. The drive shaft extends along a considerable length above the plate. By "length" is meant the largest dimension of the drive shaft, when perpendicular to the plate. The strain to which the plate is subjected is at least partially taken over by the reaction arm. Hence it is possible reduce a thickness of the supporting plate, without penalizing the rigidity of the gear motor. The gear motor of the invention can be advantageously used as a motor for the motor block of the power unit of the invention.

The invention also concerns a power unit where the motor block is equipped with an emergency braking device, capable of compensating a defect of the main drive device. Two power units equipped with such motor blocks can advantageously be mounted on two rack masts, being separated from each other but linked up via a platform.

Indeed, today, in such a case, the platform, having a total length strictly exceeding a distance separating the two masts, is interlocked, via two opposing tips, of the two masts. The power units having their own motors move up and down at varying speeds and are synchronised electrically. However, it can sometimes happen that the braking device, or the electricity supply of at least one of the power units, is faulty, i.e. that it does not work, or only partially. Hence, the tip of the interlocked platform of the power unit, whose braking device is faulty, descends faster than the tip of the interlocked platform of the power unit whose braking device functions correctly. The platform thus descends lop-sided. The mast supporting the tip of the platform descending the quickest thus bends towards the second mast, possibly causing it to break off. Such breakage of one of the masts shall, of course, entail serious consequences, not only from a material point of view, but also human.

The power unit of the invention is such that the emergency braking device is activated as soon as a difference in level between the two tips of the platform occurs. The emergency braking device thus enables to break the descent of the tip of the platform, whose braking device or electricity supply is faulty, all along the mast concerned until the two tips are once again positioned in a same perpendicular plane as the masts.

The purpose of the invention is thus a lifting assembly comprising at least one rack mast, a platform, capable of moving vertically along the mast, at least one power unit mounted onto the mast and controlling a vertical movement of the platform along the said mast, characterised in that the power unit comprises a plurality of modular elements among which at least one motor block, at least one upper roller box and at least one lower roller box, the upper and lower roller boxes being placed on either side of the motor block, each modular element comprising mechanical fastening means corresponding to those of any other modular element and coinciding with the mechanical fastening means of an adjacent modular element.

By "rack mast" is meant an assembly mainly comprised of at least two vertical uprights and a rack placed between the two vertical uprights, or along an upright.

By "platform" is meant the plate of the device to be lifted, designed for carrying loads. The platform extends along a plane basically parallel to the ground.

By "motor block" is meant all the components necessary for motorising a power unit. For example, a first motor block comprises a gear motor and a braking device, while a second motor block comprises only a gear motor.

By "roller boxes" is meant a device comprising a structure on which cylindrical wheels are mounted in staggered rows so that the vertical uprights of the mast on which the structure is mounted are surrounded by the rollers. The rollers thus enable the structure to be guided on the said uprights.

By "adjacent modular element" is meant a modular element located above or below the modular element of reference.

The modular elements are interchangeable—they all comprise mechanical fasteners placed so as to coincide one with another, from one modular element to another. It is thus possible to pile up a variable number of modular elements, in no particular order.

According to the needs of an operator, and more precisely, depending on the use of the platform on the lifting assembly, the said platform is hung on a lateral side, an upper side or a lower side of the power unit.

In particular examples of the invention's embodiment, the lifting assembly can comprise additional technical specifications, among which:

means of mechanical fastening for a modular element coinciding with those of an adjacent modular element in order to interlock the said modular elements in a reversible manner;

the lifting assembly is equipped with intermediary liaison elements comprising at least a supporting fork extending in prolongation of a roller box, perpendicular to the mast, the said supporting fork holding up the platform;

the intermediary liaison elements also comprising two vertical uprights, each one mounted at right angles and placed parallel to one another, each right-angle being equipped with a vertical upright interlocked with the lateral side of the power unit and a horizontal upright interlocked with or formed by the supporting fork;

the power unit comprising a cross-arm, the said cross-arm comprising mechanical fastening means in order to be hung onto the adjacent modular elements;

the cross-arm forms a mast protection;

the power unit comprises two motor blocks, a first motor block being interlocked with an upper tip of the cross-arm and a second motor block being interlocked with a lower tip of the cross-arm;

the power unit comprising two upper roller boxes and two lower roller boxes;

the mechanical fastening means comprising screw-passing holes for nuts and screws;

the power unit is equipped with a braking device and a braking regulator device;

the braking device comprises a centrifugal braking mechanism with a shaft driven by a movement of the power unit, and characterised in that the regulator device comprises a sliding-mounted drawer inside a cross-way casing placed inside the power unit, the two opposing tips of the drawer being located at the point of the two opposing sides of the power unit, each tip of the drawer being destined to be interlocked with one tip of a platform, a translation of a first tip of the drawer towards the inner part of the casing being accompanied by a translation of a second tip of the drawer out of the said casing, and a plate mounted in translation, and fixed in rotation, in relation to the power unit, the translations of the drawer being accompanied by a movement of the plate in the direction of a disk held up by the braking mechanism shaft;

the lifting assembly comprising two rack masts, a platform held up by the two masts and capable of being moved vertically along the said masts, two power units, each power unit being mounted on a mast, the said power units controlling a vertical movement of the platform along the masts, at least one power unit being equipped with a braking device, and with a brake pressure regulator;

the lifting assembly is equipped with a synchronisation shaft interlocked through two opposing tips of a motor and/or a parachute from each one of the power units;

the lifting assembly comprises a gear motor held up by a deck and comprising, on a first side of the deck, a driving gearing mounted onto a drive shaft of the gear motor, the drive shaft being extended perpendicularly to the deck, on a second side of the said deck, a free tip of the drive shaft, located on the second side of the deck, being interlocked with a reaction arm, the said reaction arm being fixed onto the deck;

the lifting assembly is mounted in a floating manner onto the deck and in that it is equipped with a means to measure the torque.

The purpose of the invention is also a gear motor held up by a deck and comprising, on one side of the deck, a driving gearing mounted on a drive shaft of the gear motor, characterised in that the drive shaft extends perpendicularly to the deck, on a second side of the said deck, a free tip of the drive shaft, located on the second side of the deck, being interlocked with a reaction arm, the said reaction arm being fixed onto the deck.

The reaction arm can be formed on the deck. In such a case, the deck is equipped at the point of a tip carrying the drive shaft, opposite the tip carrying the motor, with a vertical projection, extending perpendicularly in relation to the part of the deck carrying the motor and the gear box, the said projection extending almost in parallel to the drive shaft. It is also possible to embody an independent reaction arm, which is interlocked, for example by soldering or by screwing into the deck.

In a particular example, the gear motor is mounted in a floating manner onto the deck and is equipped with means for measuring the torque. Such means thus enables to weigh a transported load. By "transported load" is meant the load transported, for example, along a rack mast with the help of the said gear motor. In a particular example, the said means can, elsewhere, be capable of detecting a commitment of a braking regulator device.

Another purpose of the invention is a power unit in order to guide the lifting assembly along a rack mast, the said power unit being equipped with a motor block and a braking device, characterised in that it is equipped with braking regulator device.

Such a braking regulator device warns of any possible over-speed and can, if necessary, regulate the power unit's descending speed, and thus that of the platform.

In an example of a particular embodiment of the invention, the braking device comprises a centrifugal braking mechanism with a shaft driven by a movement of the power unit, and characterised in that the regulator device comprises a sliding-mounted drawer inside a cross-way casing placed inside the power unit, the two opposing tips of the drawer being located at the point of the two opposing sides of the power unit, each tip of the drawer being destined to be interlocked with one tip of a platform, a translation of a first tip of the drawer towards the inner part of the casing being accompanied by a translation of a second tip of the drawer out of the said casing, and a plate mounted in translation, and fixed during rotation, in relation to the power unit, the translations of the drawer being accompanied by a movement of the plate in the direction of a disk held up by the braking mechanism shaft.

The invention also concerns a lifting assembly equipped with a modular power unit, the motor block of which comprises a gear motor from the invention.

The invention further concerns a lifting assembly equipped with two rack masts, a platform supported by the two masts and capable of being moved vertically along the said masts, and two modular power units according to the invention, each power unit being mounted on a mast, the said power units controlling a vertical movement of the platform along the masts, at least one power unit comprising a braking regulator device according to the invention.

In a particular example of embodiment for such lifting assembly, the said lifting assembly shall be equipped with a synchronisation shaft interlocked by the two opposing tips of a motor and/or a parachute of each one of the power units. The synchronisation shaft can thus be interlocked by a drive shaft for each one of the motors, guaranteeing a perfect synchronisation of the two motors. By "parachute" is meant a braking device destined to stop the platform and prevent it from moving. The parachute is thus incorporated inside the motor block.

BRIEF DESCRIPTION OF THE DRAWINGS

The invention shall be better understood after reading the following description and studying the accompanying Figures. These are given as examples only and are in no way restrictive to the invention.

DETAILED DESCRIPTION OF THE INVENTION

Figure 1:
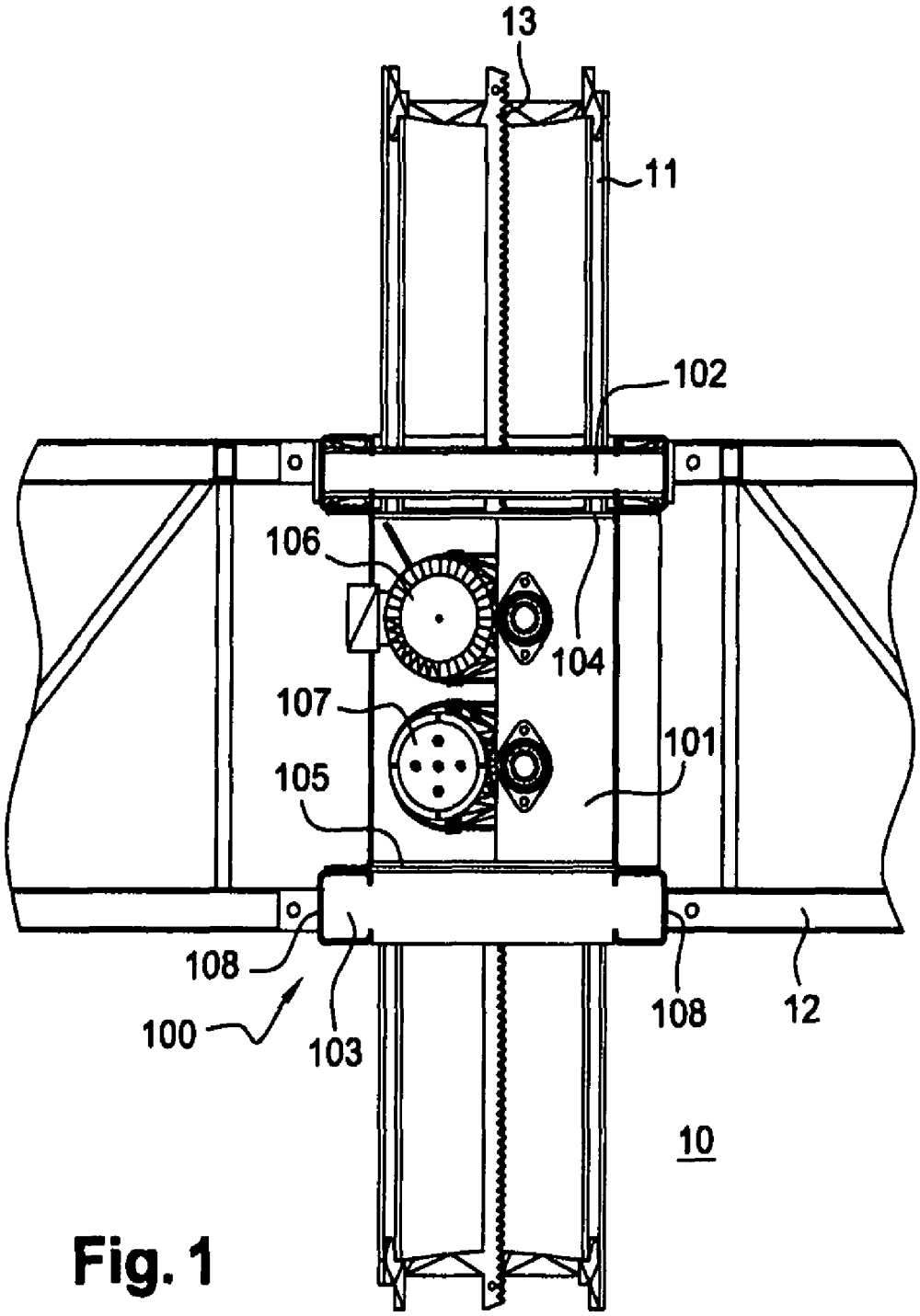
FIGS. 1, 2, 3, 4 and 5: various examples for mounting a lifting assembly of the invention.

FIG. 1 shows a lifting assembly 10 equipped with a rack mast 11 along which a platform 12 is mounted in a sliding manner, through the intermediary of a power unit 100. The power unit 100 comprises a power unit 101, surrounded by an upper roller box 102 and a lower roller box 103. The upper roller box 102 is interlocked with an upper side 104 of the motor block 101. The lower roller box 103 is interlocked with a lower side 105 of the motor block 101. By "lower" is meant directed downwards in FIG. 1, while by "upper" is meant directed upwards in the Figures. The motor block 101 comprises a gear motor 106 and a braking device 107, such as a parachute. The power unit 100 is driven on the mast 11 by the intermediary of a rack 13. An output cog (not illustrated) of the gear motor 106 is driven along the rack 13, enabling to raise or lower the power unit 100. The platform 12 being interlocked with the power unit 100, and more precisely with the upper 102 and lower 103 roller boxes, the descent or the ascent of the power unit 100 accompanies the lowering or the raising of the platform 12. Hence, the platform 12 is interlocked with the lateral sides 108 of the roller boxes, and is therefore fixed onto the sides of the power unit 100.

Figure 2:
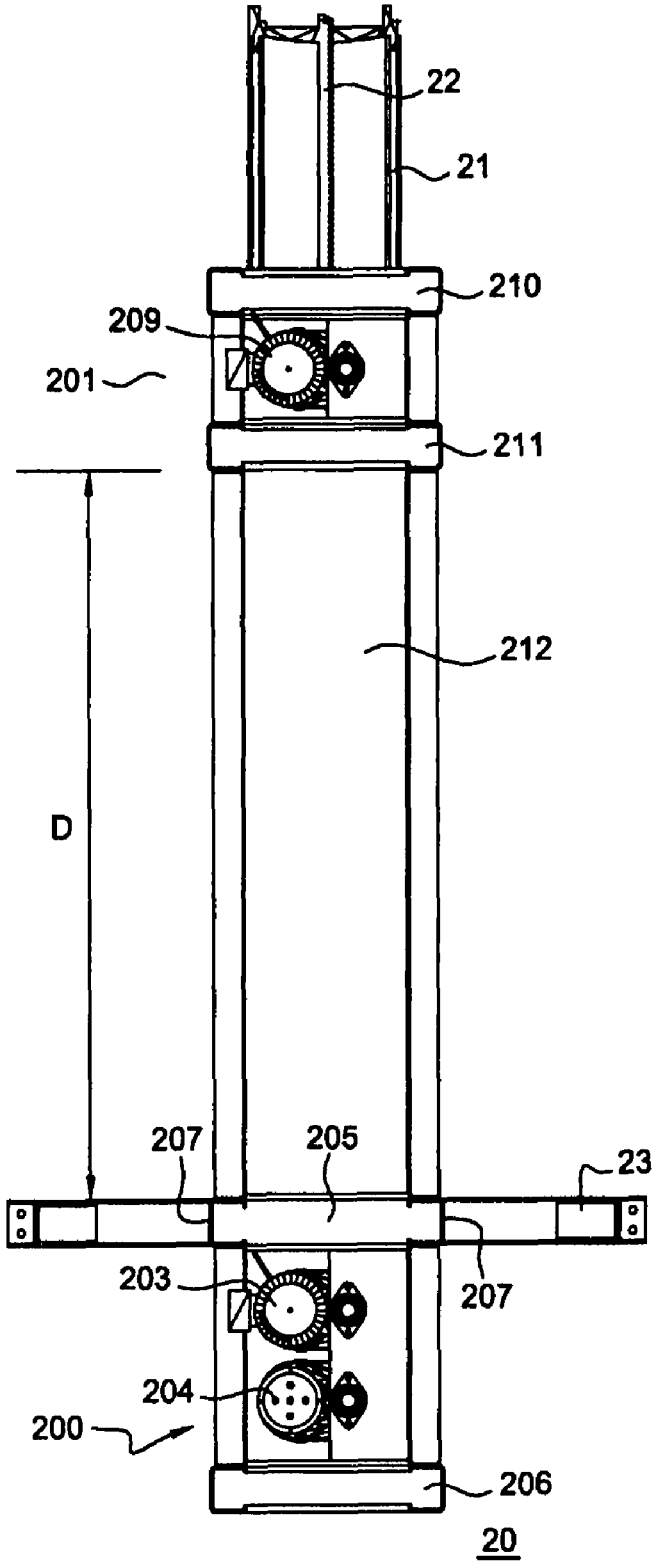

In FIG. 2 is represented another lifting assembly 20 example. The lifting assembly 20 is equipped with a mast 21 equipped with a rack 22. Two motor blocks, respectively 200 and 201, are mounted in translation on the rack mast 21. The lower motor block 200, located the lowest in FIG. 2, and comprising a gear motor 203 and a parachute 204. The lower motor block 200 is mounted between an upper roller box 205 and a lower roller box 206. A fork 23, destined to host an elevator cabin, is mounted on the lateral sides 207 of the upper roller box 205 located above the lower motor block 200. The upper motor block 201 comprises a gear motor 209. An upper roller box 210 and a lower roller box 211 surrounding the upper motor block 201. A cross-arm 212 is mounted on the mast 21 between the lower roller box 211 and the upper roller box 205. The cross-arm 212 increases a distance D separating the lower motor block 200 from the upper motor block 201. By "distance D" is meant the dimension, parallel to the mast 21, separating the two motor blocks 200 and 201. By increasing the distance D between the two motor blocks 200 and 201, the strain that the power unit has to supply in order to regain the moment generated by the excentration of the load to be transported is thus reduced. Thus, the strain on the rollers is reduced, taken over by the mast 21, when the platform 23 carries a heavy weight. Thus the risks of rupture of the mast 21 are reduced and a motivity of the platform 23 is otherwise made easier. Furthermore, the cross-arm enables to protect the mast from any hitches and knocks, and the workmen from any risks of shearing and/or crushing.

The power unit according to FIG. 2 therefore comprises two motor blocks 200 and 201, four roller boxes 206, 205, 211, 210 and a cross-arm 212. In this example of embodiment, the platform 23 is interlocked with the roller box 205, interlocked with the lower motor block 200.

Figure 3:
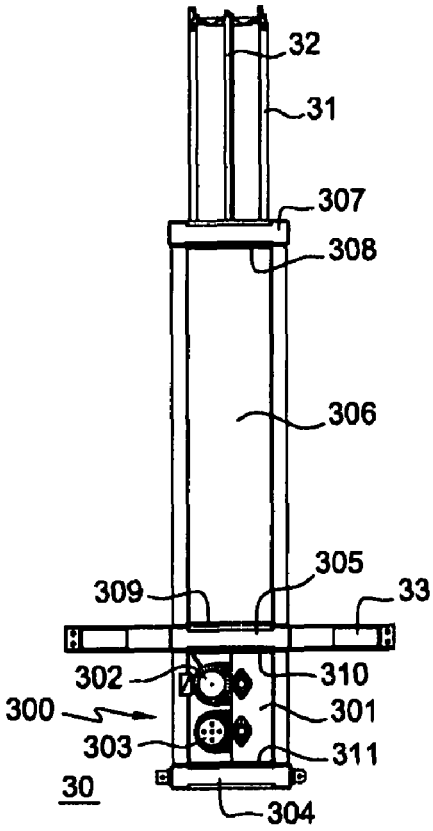

In FIG. 3 can be seen a third lifting assembly embodiment example 30 of the invention. The lifting assembly 30 is equipped with a rack 32 mast 31 on which is mounted in translation a load platform 33. The load platform 33 is made mobile along the mast 31 through the intermediary of a power unit 300. The power unit 300 comprises a motor block 301 equipped with a motor gear 302 and a parachute 303. A lower roller box 304 and an upper roller box 305 surround a motor block 301. Furthermore, the power unit 300 comprises a cross-arm 306 and a third roller box 307 located at the point of an upper side 308 of a cross-arm 306. Hence, the power unit 300 is equipped, in the following order, with an upper roller box 307 interlocked with an upper side 308 of a cross-arm 306, itself interlocked with an upper side 309 of a second upper roller box 305, itself interlocked with an upper side 310 of a motor block 301, itself interlocked with an upper side 311 of a lower roller box 304. In this example of an embodiment, the load platform 33 is interlocked with an upper side of a power unit 300. The platform 33 is located above the power unit 300.

Figure 4:
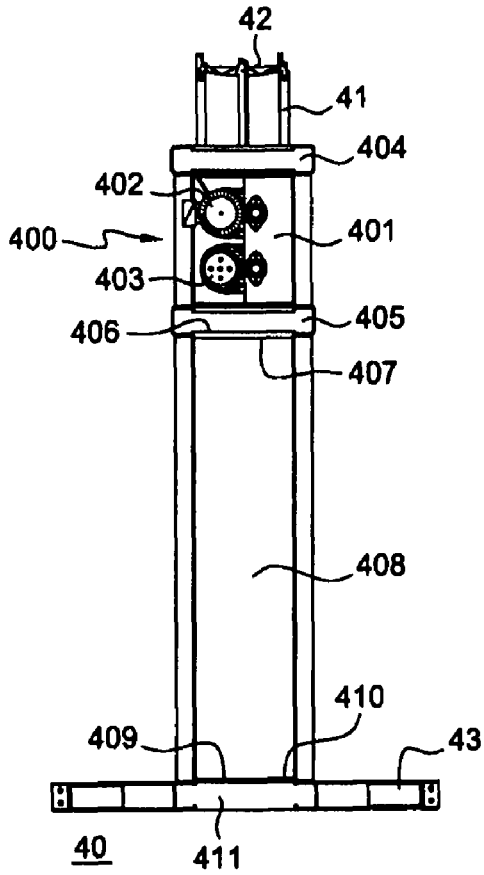

In FIG. 4 is shown a fourth lifting assembly embodiment example 40 of the invention. The lifting assembly 40 is equipped with a rack 42 mast 41, along which a load platform 43 is mounted in translation. The translation is allowed with the help of a power unit 400. The power unit 400 comprises a motor block 401 equipped with a gear motor 402 and a parachute block 403. The motor block 401 is surrounded by an upper roller box 404 and a lower roller box 405. A lower side 406 of the lower roller box 405 is interlocked with an upper side 407 of a cross-arm 408. A lower side 409 of the cross-arm 408 is itself interlocked with an upper side 410 of a second lower roller box 411. The load platform 43 is interlinked to the second lower roller box 411. Hence, the motor block 401 is located above the load platform 43.

Figure 5:
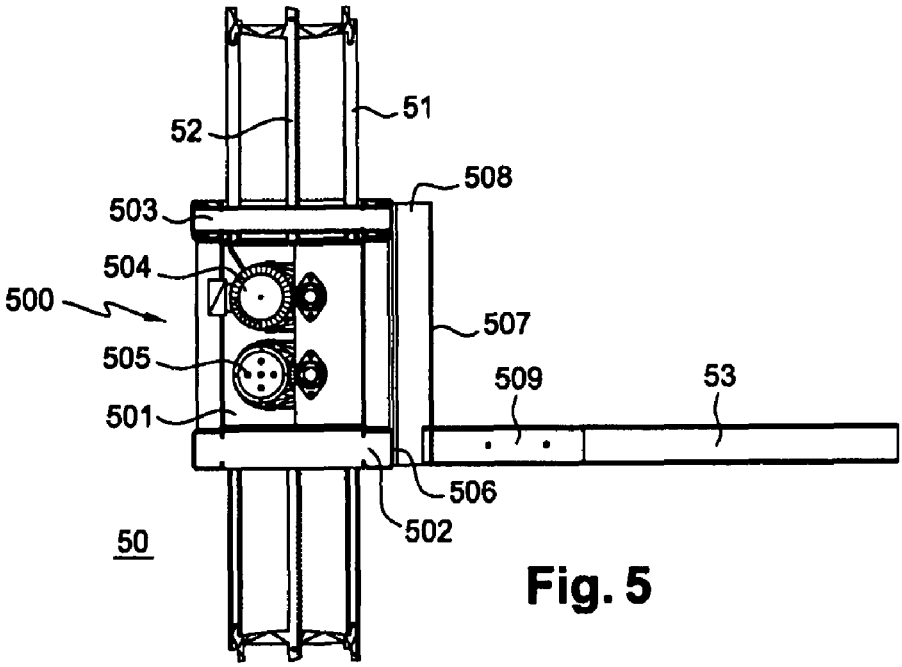

In FIG. 5 is shown a fifth lifting assembly embodiment example 50 of the invention. The lifting assembly 50 is equipped with a rack 52 mast 51 and a power unit 500. The power unit 500 is equipped with a motor block 501 surrounded by a lower roller box 502 and an upper roller box 503. The motor block 501 comprises a gear motor 504 and a parachute 505. The power unit 500 enables to move a load platform 53 up or down along the mast 51. Platform 53 is located on one side of the power unit 500. The load platform 53 is mounted with an overhang over a single lateral side 506 of the roller boxes 501 and 502.

In a particular example of the invention's embodiment, and as this is shown in FIG. 5, in order to allow a better hold and a better fitting of the load platform 53 along mast 51, such load platform 53 shall be fixed with the power unit 500 through the intermediary of two right-angles 507 (only one single right-angle illustrated), fixed on the power unit 500 on the one hand, and on the load platform 53 on the other. A vertical upright 508 of the right-angle 507 is interlocked with the power unit 500, while a horizontal upright 509 for the right-angle 507 is interlocked on the load platform 53. In another embodiment example, the horizontal upright 509 is formed by the load platform 53 itself.

The strain is distributed over the power unit 500, through the intermediary of the vertical upright 508. Hence, this is not only the lower roller box 502 which takes over the strain coming from the platform 53, but the two roller boxes, respectively lower 502 and upper 503.

In an embodiment example, it is possible to use one or several supporting forks. Each supporting fork is interlocked with a corresponding roller box. Hence, the platform can be moved, carried by the supporting fork. The supporting fork can have, for example, a coupling tip capable of being embedded along a recessed fitting length on a roller box of the power unit. In the case where right-angles 507 are otherwise used, the supporting fork is interlocked with the right-angles 507, or partially forms the said right-angles 507.

The power unit of the invention is thus equipped with a plurality of modular elements comprising at least two roller boxes, at least one motor block, and possibly a cross-arm. The number of roller boxes, motor blocks and the existence or not of a cross-arm varies according to the platform which must be moved along the mast.

Figure 6A:
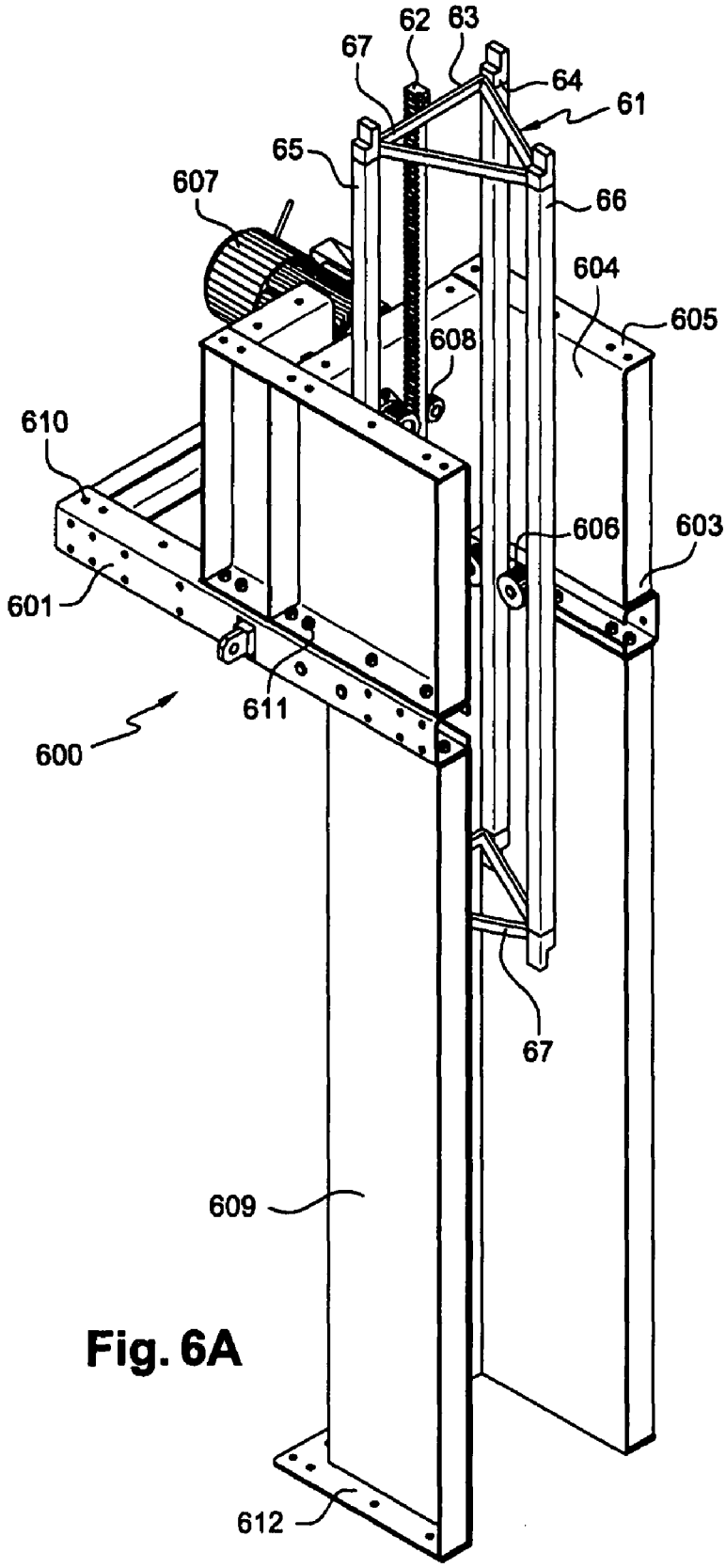
FIGS. 6A and 6B: a detailed view of a power unit according to an embodiment example of the invention.
Figure 6B:
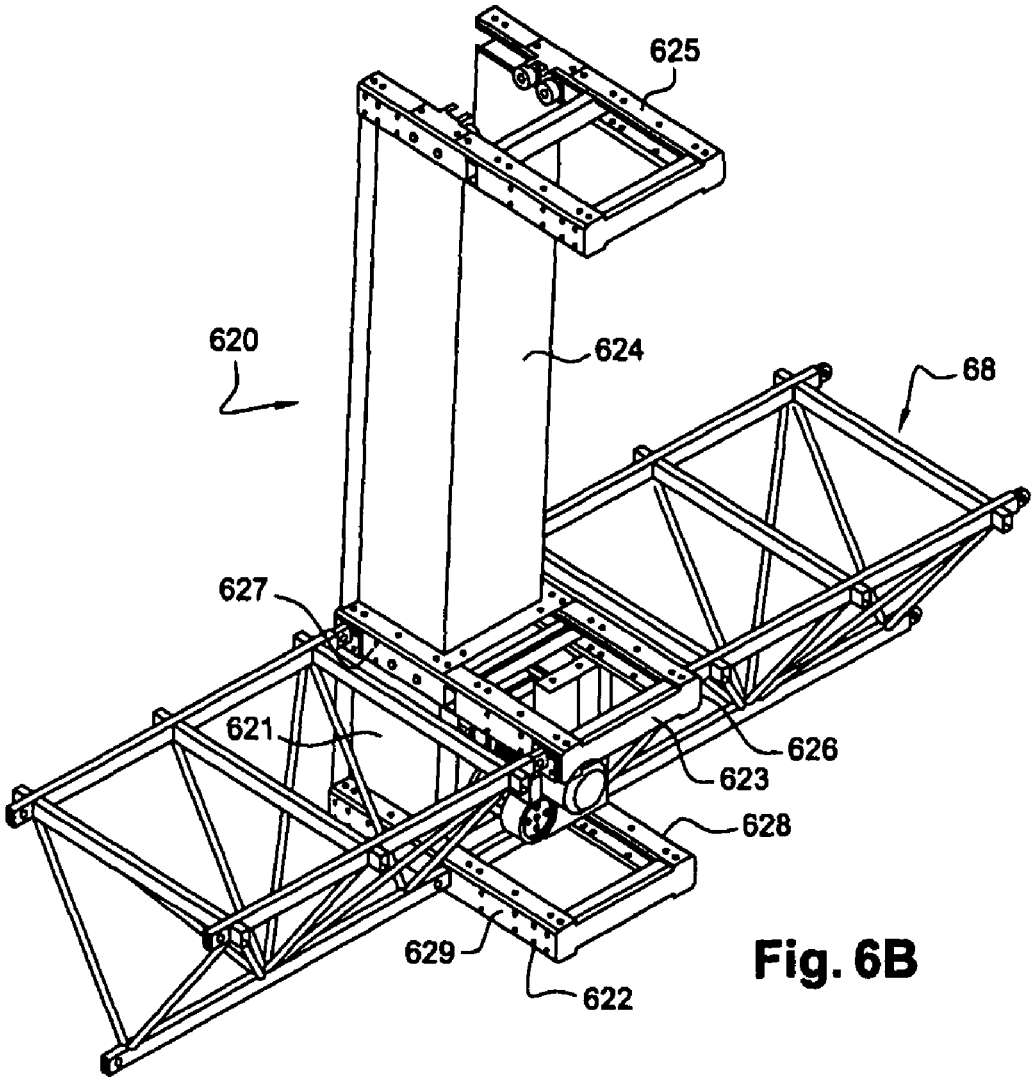

In FIGS. 6A and 6B, certain modular elements of the two power units 600 and 620 of the invention are shown.

In FIG. 6A, the power unit 600 is mounted onto a triangular section mast 61. By "triangular section" is meant that the mast 61 is a mast with 3 sides, one of the sides 67 carrying a rack 62. The side 63 of the mast 61 carrying the rack 62 also carries the power unit 600. The power unit 600 is partially represented in FIG. 6A. We can indeed see that the power unit 600 comprises a lower roller box 601 interlocked with a lower side 603 of a motor block 604. Preferably, the power unit 600 also comprises an upper roller box (not illustrated) interlocked with an upper side 605 of the motor block 604. Indeed, the roller boxes enable to guide the motor block 604, which itself has a power function along the mast 61.

By surrounding the motor block 604 by two roller boxes 601, the said motor block 604 is prevented from being separated from the mast 61, and more precisely from the rack 62. Indeed, each roller box 601 is equipped with guiding rollers 606 (only 2 guiding rollers 606 illustrated in FIG. 6A). The mast 61 is, as mentioned earlier, equipped with three sides. The mast 61 is more precisely formed of three vertical uprights, respectively 64, 65 and 66, placed one in relation to another in order to form a triangle, the said vertical uprights 64, 65 and 66 being linked together by transverse bars 67 regularly spaced out along the mast 61. Hence, the front side 63 of the mast 61 is formed by two vertical uprights 64 and 65 and the transversal bars 67 linking the two vertical uprights 64 and 65 to each other. The rack 62 is interlocked with the transverse bars 67. The guiding rollers 606 of the upper and lower roller boxes of the power unit 600 surround the vertical uprights 64 and 65. In other words, each roller box 601 is equipped with at least six guiding rollers 606, placed in groups of three, so that each vertical upright 64 is surrounded by three guiding rollers 606.

Furthermore, the motor block 604 of the power unit 600 is equipped with at least a rack kicking-roller 608 rolling along a smooth side of the rack 62.

The power unit 600 further comprises a cross-arm 609. Such modular elements, respectively a roller box 601, a motor block 604 and a cross-arm 609, are interlocked with each other, depending on the needs, using mechanical fastening means enabling to interlock the various modular elements with each other. In the examples illustrated, the mechanical fastening elements are formed of holes 610, of screws 611 and nuts; in other words, that the holes 610 on a first modular element coincide with the holes 610 on an adjacent second modular element. Screws are then inserted in the said holes 610, which are held in place in the two coinciding holes 610 using a nut in order to maintain the said modular elements together in a mechanical manner. In another embodiment example, it is also possible to plan to maintain the said modular elements in place by soldering.

Each modular element, 601, 604, 609, comprises on the front side of high and low tips a flat surface 612 on which are made the holes 610. By "flat surface" 612 is meant a sheet metal extending perpendicularly to an axis of the concerned modular element. When two modular elements are to be interlocked with each other, the flat surface 612 located on the front side of an upper tip of a modular element is placed on the flat surface 612 located on the front side of lower tip of the adjacent modular element.

In FIG. 6B, the power unit 620 comprises a power unit 621, surrounded by a lower roller box 622 and an upper roller box 623. The upper roller box 623 is interlocked with a cross-arm 624, itself interlocked with a second upper roller box 625. A platform 68 is interlocked with the lateral sides 626, 627, 628 and 629 of the upper 623 and lower 622 roller boxes of the power unit 621.

Figure 7:
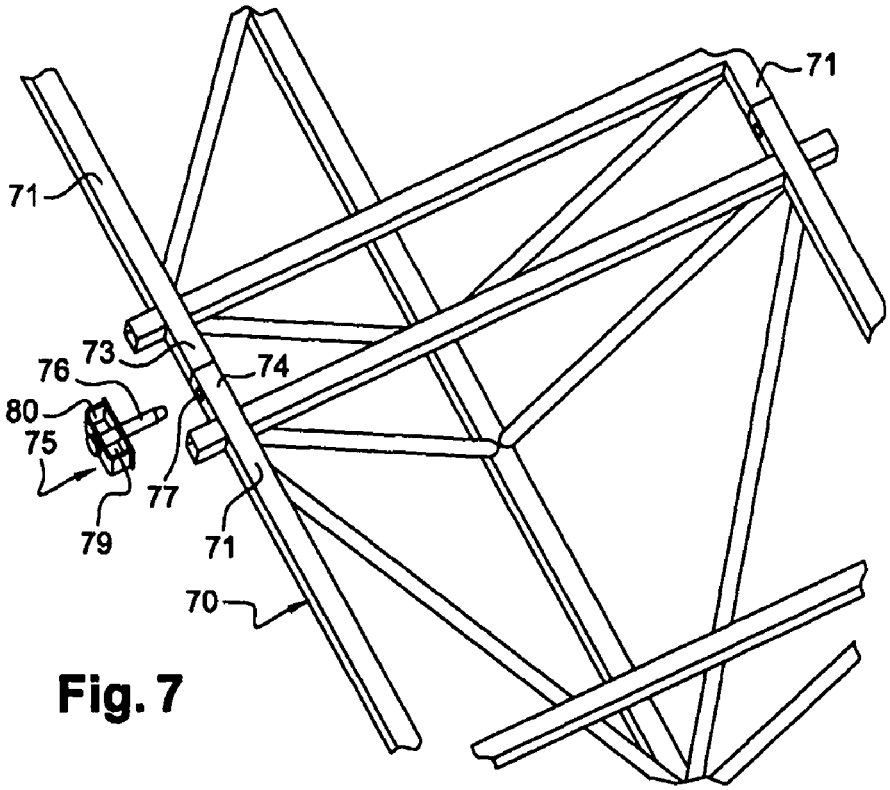
FIG. 7: an enlargement of a platform according to an example of the invention, at the junction point between two tubular elements of the said platform.

In FIG. 7 is illustrated an enlargement of a work plate 70 able to be carried by a power unit of the invention. The work plate 70 is equipped with a succession of horizontal tubular elements 71 capable of fitting exactly into each other. In other words, a tip of a first horizontal tubular element 71 is capable of fitting exactly into a second horizontal tubular element 71, and so on, one after the other, until obtaining a desired platform length 70. The adjacent horizontal tubular elements 71 are linked together by a linking device 75. A horizontal tubular element 71 is equipped with a tip 73 capable of fitting exactly into a tip 74 of an adjacent horizontal tubular element 71. The linking device 75 enables to maintain in place such exact fitting.

In order to do that, the linking device 75 is equipped with an axis 76 carrying two sheaths 79 and 80. The axis 76 is housed in a hole 77, the hole 77 corresponding to the superposing of the two holes placed at the point of the two exact-fitting tips 73 and 74. The axis 76 is maintained in position in the hole 77, for example using a pin. The sheaths 79 and 80 are capable of hosting the railings forming, for example, the guardrails.

Figure 8:
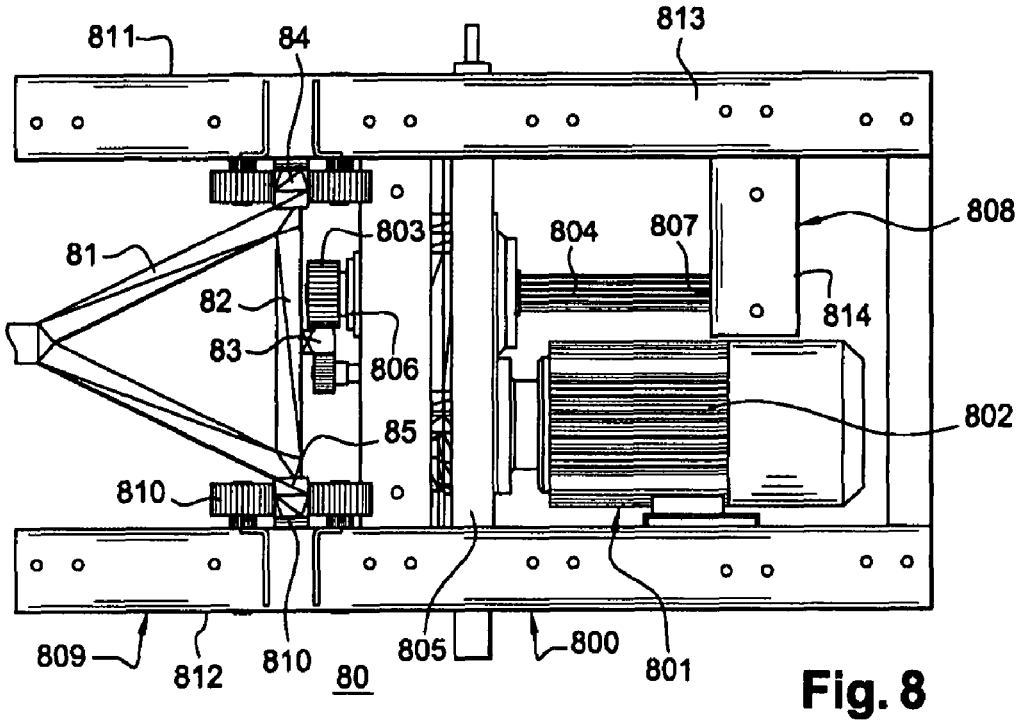
FIG. 8: a cross-sectional view of a mast and of a power unit equipped with a gear motor according to an embodiment example of the invention.

In FIG. 8 can be seen a lifting assembly 80 of the invention, as a cross-sectional view, at the point of the motor block of the power unit 800. A mast 81 is equipped, on top of a front side 82, with a rack 83. The power unit 800 is mounted in translation on and along the front side 82 of the mast 81, in order to mesh with the rack 83. The power unit 800 especially comprises a gear motor 801. The gear motor 801 comprises a motor 802 and a reducer (not illustrated), of which the meshing cog 803 enables to mesh with the rack 83 in order to raise or lower the power unit 800 along the mast 81. The gear motor 801 is carried by a deck 805. The deck 805 is guided along the mast 81 through the intermediary of the roller boxes of the power unit 800 (see FIG. 6A, the link between the mast and power unit). A drive shaft 804 of the gear motor 801 extends perpendicularly to the deck 805. The deck 805 carries the drive shaft 804. A first tip 806 of the drive shaft 804 enables to drive the meshing cog 803. A second tip 807, opposite to the first tip 806, or free tip, is interlocked with a reaction arm 808 and is guided into the deck 805 through the intermediary of a bearing. The reaction arm 808 is fixed onto the deck 805. The reaction arm 808 extends perpendicularly to the deck 805. More precisely, the reaction arm 808 has a general L-shape. A first bar 813 of the "L" 808 extends perpendicularly to the deck 805 and in parallel to the drive shaft 804. A second bar 814 of the "L" 808, which supports the free tip 807 of the drive shaft 804, extends perpendicularly to the first bar 813, in the direction of the drive shaft 804. The drive shaft 804 is freely mounted in rotation on the reaction arm 808. In other words, the drive shaft 804 is capable of being driven in rotation, by the motor 802, the reaction arm 808 only being there to maintain the reaction arm 808 in position and in order to take over strain.

In the example illustrated, the reaction arm 808 belongs to the deck 805. By that is meant that the plate 805 is moulded with the reaction arm 808, i.e. the deck 805 is moulded with the reaction arm 808. In another embodiment example, it is possible to interlock an independent reaction arm 808 with the deck 805. For example, the reaction arm 808 is interlocked with the deck 805 through the intermediary of mechanical fastening means, such as the holes for the nuts and screws, or by soldering.

Furthermore, FIG. 8 also illustrates a roller box 809, at the point of the guiding rollers 810. Each lateral side 811 and 812 of the roller box 809 comprises three guiding rollers 810. The vertical uprights 84 and 85 of the mast 81, forming the front side 82, are each surrounded by three guiding rollers 810. Two guiding rollers 810 are placed on either side of a vertical upright 84 or 85. The third guiding roller 810 is set back in relation to the two other rollers 810 in order to surround the upright 84 or 85.

In a particular embodiment example of the invention, the roller box 809 can be embodied so that the rollers 810 can have two different positions inside the said roller box 809. More precisely, a first position of the rollers 810 enables to guide the power unit 800 along a mast 81 of larger dimensions than a second position of the said rollers 810. In the second position, the rollers 810 are more advanced in the direction of the mast, which enables to guide the power unit 800 along a mast of smaller dimensions.

Figure 9A:
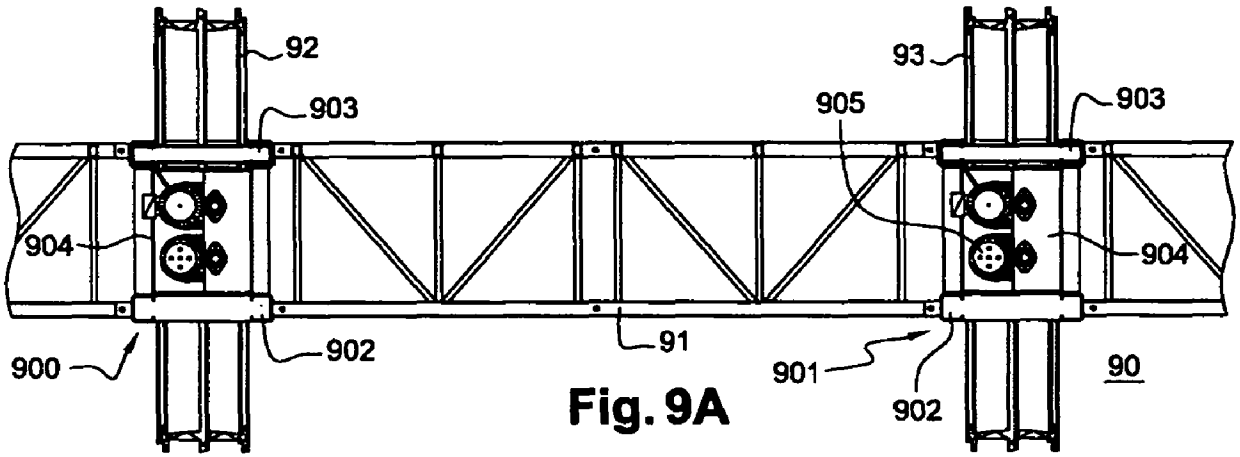
FIGS. 9A and 9B: a diagram of a platform with two masts with, respectively, a functional braking device, and with a faulty braking device.
Figure 9B:
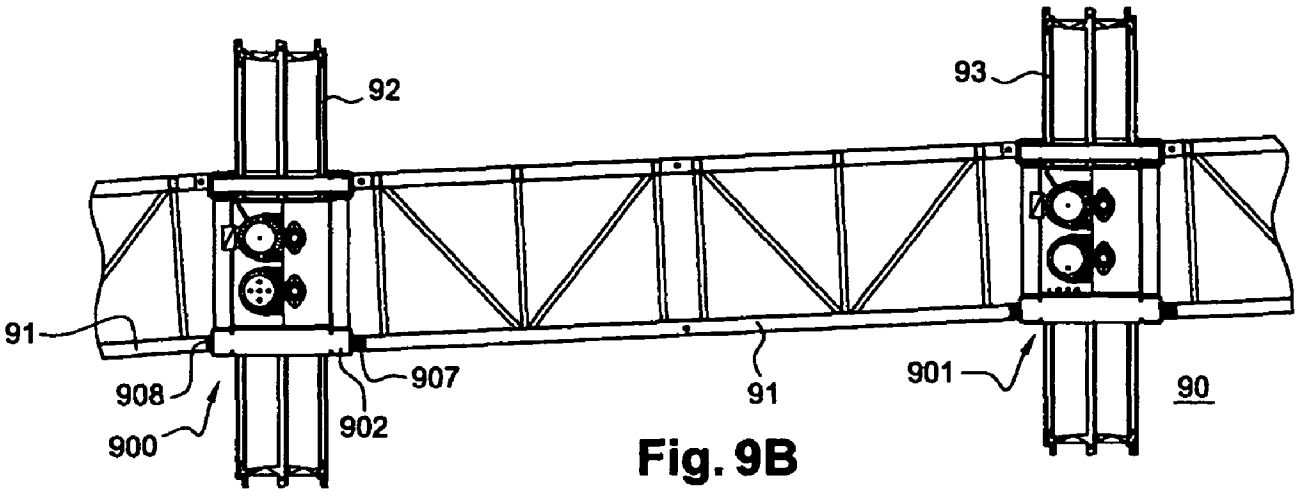

In FIGS. 9A and 9B is illustrated a particular lift 90. In FIG. 9A, the lift 90 is equipped with a platform 91 extending perfectly perpendicular to two rack masts 92 and 93. In FIG. 9B on the other hand, the platform 91 is lop-sided on the masts 92 and 93. By "lop-sided" is meant that all or part of the platform 91 extends in an oblique manner in relation to the two masts 92 and 93.

The lift 90 is equipped with two rack masts 92 and 93 between which a platform 91 is mounted in translation along the said masts 92 and 93 through the intermediary of the two power units, respectively 900 and 901, each power unit 900 and 901 being mounted in translation along a rack mast 92 or 93.

Each power unit 900 and 901 is equipped with a lower roller box 902 and an upper roller box 903 surrounding a motor block 904. During a translation of such a platform 91, it is important that the two power units 900 and 901 work in a synchronised manner so that the said work plate 91 remains perfectly plane in relation to the rack masts 92 and 93. By "perfectly plane" is meant that the platform 91 extends in a plane perpendicular to the planes containing the rack masts 92 and 93. However, it is possible that the braking device 905 of a motor block 904 does not work as well on one of the two power units 900 or 901, or that a motor with a heavier load descends faster than the other. Hence, during a descent by the platform 91 along the two rack masts 92 and 93, a tip of the platform 91 interlocked with the faulty power unit descends faster than the tip of the platform 91, opposite the first tip, interlocked with the power unit working properly. In order to prevent that, the power units 900 and 901 of the invention are equipped, in addition to the braking device 905, with a braking regulator device 906. The braking regulator device 906 is, for example, located at the point of the lower roller box 902.

Figure 10:
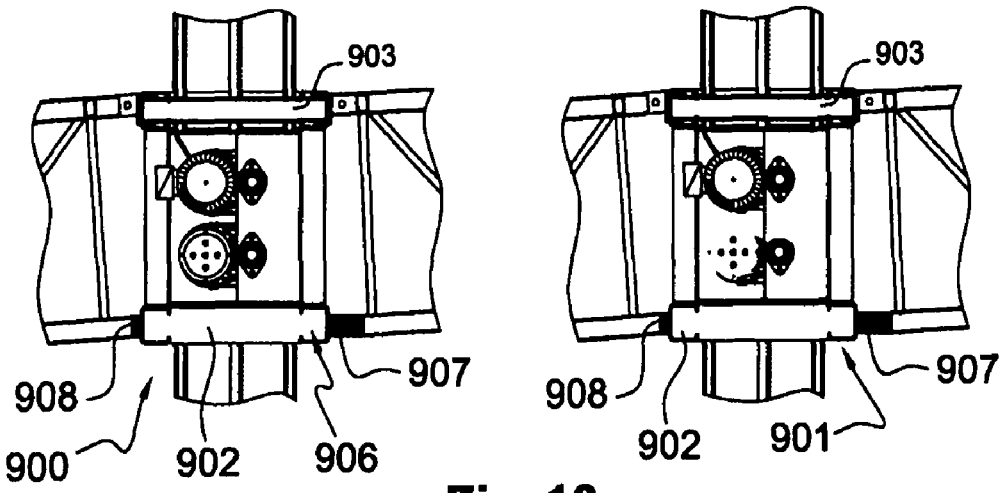
FIG. 10: an enlargement of FIG. 9B at the point of the power units.

As illustrated more precisely in FIG. 10, the power units 900 and 901 are equipped, at the point of their lower roller box 902, with a drawer device 906. By "drawer device" is meant means going right across the lower roller box 902, capable of sliding inside a housing placed inside the lower roller box 902 (not illustrated). The tips of the platform 91 are interlocked with the lower roller box 902 of each power unit 900 and 901 through the intermediary of the drawer device 906. Thus, the platform 91 is not mounted rigidly on the roller boxes 902. The drawer device 906 enables a certain leeway of the platform 91 in relation to the lower roller boxes 902. Indeed, the opposing tips 907 and 908 of a drawer located in a roller box 902 have a mechanical link with the tips of the platform 91. Hence, when a first tip 907 of the drawer comes out of its housing, the second tip 908 of the said drawer will then enter in turn the said housing, through the opposing end of the housing.

Hence, when a tip of the platform 91, interlocked with a lower roller box 902, is drawn to the right in FIG. 9 or FIG. 10, an opposing tip of platform 91, interlocked with a opposing lateral side of the same roller box 902, is also drawn towards the right. This is made possible by the sliding movement of the drawers in the drawer devices 906 placed inside the lower roller boxes 902 of the two power units 900 and 901. In order to maintain a constant gap between the masts 92 and 93, i.e. to prevent one of the masts from bending, the sliding movement of the drawer devices 906 is performed symmetrically inside the two power units 900 and 901 of the two masts 92 and 93.

Figure 11:
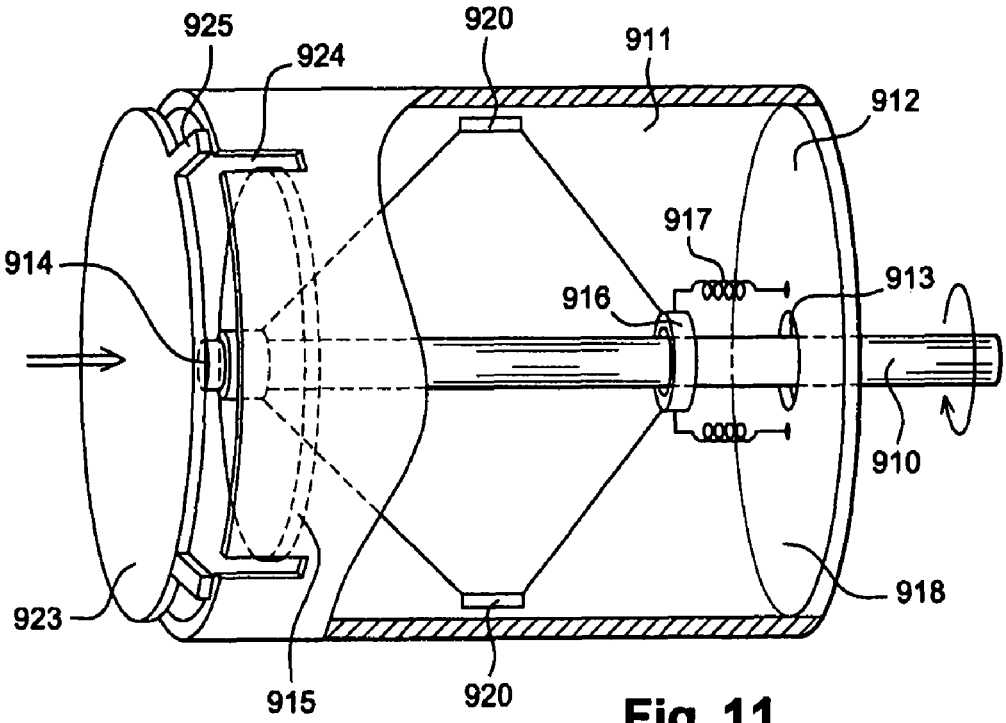
FIG. 11: a diagram of an operating method for a braking device and a braking regulator device of the invention.

The tips 907 and 908 of the drawer by respectively entering and exiting the housing placed inside the roller box 902, enables to activate a device equivalent to an emergency break, for which a method of working is shown in FIG. 11.

In FIG. 11 is illustrated a sketch of the braking device 905 and of the braking regulator device 906 of the motor block 904.

The braking device 905 comprises, for example, a centrifugal braking device housed in a cylindrical box 911, and a shaft 910 driven by a movement from the power unit 900 or 901.

The shaft 910 is mounted in rotation inside the box 911. A first tip of the box 911 is closed by a first cover 912 fixed onto the box 911. A second tip is hidden by a second cover 915.

The shaft 910 enters the box 911 through a gap 913 placed on the first cover 912. A free tip 914 of the shaft 910, opposite to a tip driven into rotation (not illustrated), is interlocked with the second cover 915. The shaft 910 is maintained in position inside the gap 913 with a clamping ring 916 and springs 917, the springs 917 being interlocked with the clamping ring on the one hand 916 and with an inner face 918 of the first cover 912 on the other.

The braking device 905 is also equipped with two runners 920 destined to be applied against the inner wall of the cylinder 911. A rubbing of the runner 920 against the said wall enables to slow down, or even to stop, the rotation of the cylinder 911.

When the braking device 905 of one of the power units 900 or 901 is faulty, the platform 91 descends lop-sided. A slanting position of the platform 91 enables the drawer devices 906 of the two power units 900 and 901 to be moved in translation inside their respective housing. The drawer of the power unit 900 or 901 having the lowest action, by being translated, a connecting rod is activated, through the intermediary of a rotating arm, and presses on a disk 923 of the braking regulator device 906 against the second cover 915. The disk 923 is fixed during rotation. Hence, when the disk is applied against the cylinder 911, the rotation of the said cylinder 911 is slowed down, bringing the two power units 900 and 901 down to the same speed.

In a particular example, and such as represented in FIG. 10, the cover 923 is equipped with tabs 925 capable of being housed in the housings 924 placed in the box 911. The tabs 925 extend from the radius towards the outside on the said cover 923. When the cover 923 is applied in the direction of the box 911, the tabs 925 are inserted into the housings 924.

The cover 923 being fixed during rotation, a rotation of the cylindrical box 911 is thus forbidden.

The invention claimed is:

1. A modular lifting assembly comprising:

a first rack mast, a platform capable of moving vertically along the first rack mast;

a first power unit mounted onto the first rack mast and controlling a vertical movement of the platform along the first rack mast, the first power unit comprising a plurality of modular elements, the modular elements including:

a first motor block having an upper side and a lower side, the upper side forming a substantially flat upper surface defining a plurality of upper holes, the lower side forming a substantially flat lower surface defining a plurality of lower holes and;

an upper roller box including an upper side forming a substantially flat upper surface and defining a plurality of upper holes, a lower side forming a substantially flat lower surface and defining a plurality of lower holes coinciding with the upper holes of the upper roller box and the upper and lower holes of the motor block, and a lateral side forming a substantially flat lateral surface and defining a plurality of lateral holes;

a lower roller box substantially the same as the upper roller box, such that the first and the second roller boxes are interchangeable;

wherein the lower surface of the upper roller box is held adjacent the upper surface of the upper side of the first motor block with a plurality of upper fasteners inserted through the coinciding plurality of holes of the lower side of the upper roller box and the upper side of the first motor block such that the upper roller box is removably interlocked with the first motor block, and an upper surface of the lower roller box is held adjacent the lower surface of the lower side of the first motor block with a plurality of lower fasteners inserted through a coinciding plurality of holes of an upper side of the lower roller box and the lower side of the first motor block such that the lower roller box is also removably interlocked with the first motor block.

2. The assembly according to claim 1, wherein the platform is hung on a lateral side, an upper side or a lower side of the power unit.

3. The assembly according to claim 1, including intermediary liaison elements comprising at least one supporting fork being extended in prolongation of one of the upper roller box or the lower roller box, perpendicular to the mast, the supporting fork holding up the platform.

4. The assembly according to claim 3, wherein the elements of the intermediary liaison also comprise two vertical uprights, each one mounted at right angles and placed parallel to one another, each right-angle being equipped with a vertical upright, interlocked with a lateral side of the power unit and with a horizontal upright interlocked with or formed by the supporting fork.

5. The assembly according to claim 1, the first power unit further comprising a cross arm including an upper side having a plurality of upper holes coinciding with the lower holes of the lower roller box and a lower side having a plurality of lower holes coinciding with the upper holes of the upper roller box, such that the cross arm may be attached adjacent to any of the modular elements.

6. The assembly according to claim 5, wherein the cross-arm forms a mast protection.

7. The assembly according to claim 1, wherein the power unit further comprises a second motor block, the first motor block being interlocked with an upper tip of the cross-arm and the second motor block being interlocked with a lower tip of the cross-arm.

8. The assembly according to claim 1, wherein the power unit comprises two upper roller boxes and two lower roller boxes.

9. The assembly according to claim 1, wherein the plurality of upper fasteners and the plurality of lower fasteners comprise nuts and screws.

10. The assembly according to claim 1, wherein the power unit is equipped with a braking device and with a brake pressure regulator.

11. The assembly according to claim 10, wherein the braking device comprises a centrifugal braking mechanism with a shaft driven by a movement from the power unit, and wherein the brake pressure regulator device comprises a sliding-mounted drawer inside a cross-way casing placed inside the power unit, two opposing tips of the drawer being located at the point of the two opposing sides of the power unit, each tip of the drawer being adapted destined to be interlocked with one tip of a platform, a translation of a first tip of the drawer towards an inner part of the casing being accompanied by a translation of a second tip of the drawer out of the casing, and a plate mounted in translation, and fixed in rotation, in relation to the power unit, the translations of the drawer being accompanied by a movement of the plate in a direction of a disk held up by the breaking device shaft.

12. The lifting assembly according to claim 1, further comprising a second rack mast, the platform held up by the first rack mast and the second rack mast and capable of being moved vertically along the masts, and a second power unit two power units, the first power unit being mounted on the first rack mast, the second power unit being mounted on the second rack mast, the first and second power units controlling a vertical movement of the platform along the first and second rack masts, at least one of the first power unit or the second power unit being equipped with a braking device and with a brake pressure regulator.

13. The lifting assembly according to claim 12, further comprising a synchronisation shaft interlocked through two opposing tips of a motor and/or a parachute from each of the first and the second power units.

14. The lifting assembly according to claim 1, the motor block further having a gear motor held up by a deck and on a first side of the deck, a driving gearing mounted onto a drive shaft of the gear motor, the drive shaft being extended perpendicularly to the deck, on a second side of the said deck, a free tip of the drive shaft, located on the second side of the deck, being interlocked with a reaction arm, the reaction arm being fixed onto the deck.

15. The lifting assembly according to claim 14, the gear motor being mounted in a floating manner onto the deck and including a torque measurement device for measuring the torque of the gear motor.

* * * * *